US005309596A

United States Patent [19]

Simms

[11] Patent Number: 5,309,596

[45] Date of Patent: May 10, 1994

[54] INTERPROXIMAL BRUSH

[75] Inventor: Graham J. Simms, Brookline, Mass.

[73] Assignee: The Gillette Company, Boston, Mass.

[21] Appl. No.: 34,281

[22] Filed: Mar. 23, 1993

[51] Int. Cl.[5] ..... A46B 9/04

[52] U.S. Cl. ..... 15/167.1; 15/172; 15/185; 132/321

[58] Field of Search ..... 15/185, 144.1, 145, 15/146, 167.1, 172, 201, 206; 128/62 A; 132/308, 313, 317, 321, 218; D4/104, 121, 128, 131, 133, 138; D28/7, 64

[56] References Cited

U.S. PATENT DOCUMENTS

| | | | |
|---|---|---|---|
| D. 144,385 | 4/1946 | Katz . | |
| D. 272,100 | 1/1984 | Cassai et al. | D28/7 |
| D. 279,132 | 6/1985 | Cassai et al. | D28/7 |
| D. 293,858 | 1/1988 | Tarrson et al. | D4/104 |
| D. 300,946 | 5/1989 | Tarrson et al. . | |
| D. 304,785 | 11/1989 | Tarrson et al. | D4/104 |
| D. 317,061 | 5/1991 | Cassai et al. | D28/7 |
| D. 324,585 | 3/1992 | Cassai | D28/7 |
| D. 324,957 | 3/1992 | Piano | D4/104 |
| D. 325,791 | 4/1992 | Cassai | D28/7 |
| D. 325,792 | 4/1992 | Cassai | D28/7 |
| D. 325,793 | 4/1992 | Cassai | D28/7 |
| D. 329,142 | 9/1992 | Discko, Jr. et al. | D4/104 |
| 759,490 | 5/1904 | Yates . | |
| 1,369,664 | 2/1921 | Izawa . | |
| 1,391,783 | 9/1921 | McDermott et al. . | |
| 1,770,195 | 7/1930 | Burlew | 15/167.1 |
| 1,928,328 | 9/1933 | Carpentier | 15/172 |
| 2,411,610 | 11/1946 | Aaron | 15/172 |
| 2,454,995 | 11/1948 | Curran . | |
| 2,570,412 | 10/1951 | Vogel | 15/145 |
| 2,604,649 | 7/1952 | Stephenson et al. | 15/201 |
| 2,676,350 | 4/1954 | Bressler | 15/167.1 |
| 2,807,820 | 10/1957 | Dinhofer | 15/176.1 |
| 2,915,767 | 12/1959 | Vaughan | 15/167.1 |
| 3,193,864 | 7/1965 | Makowsky | 15/172 |
| 3,350,737 | 11/1967 | Makowsky | 15/172 |
| 3,493,991 | 2/1970 | De Bianchi . | |
| 3,720,975 | 3/1973 | Nelson . | |
| 4,030,199 | 6/1977 | Russel . | |
| 4,162,553 | 7/1979 | Bruno . | |
| 4,319,377 | 3/1982 | Tarrson et al. | 15/111 |
| 4,387,479 | 6/1983 | Kigyos . | |
| 4,395,943 | 8/1983 | Brandli . | |
| 4,520,526 | 6/1985 | Peters . | |
| 4,572,223 | 2/1986 | Rosenfeld . | |
| 4,691,404 | 9/1987 | Tarrson et al. . | |
| 4,712,266 | 12/1987 | Yamaki | 15/167.1 |
| 4,751,761 | 6/1988 | Breitschmid . | |
| 4,780,923 | 11/1988 | Schultheiss | 15/111 |
| 4,809,389 | 3/1989 | Breitschmid | 151/167.1 |
| 4,828,420 | 5/1989 | Otsuka et al. . | |
| 4,850,074 | 7/1989 | Klevan | 15/185 |
| 5,001,803 | 3/1991 | Discko, Jr. | 15/167.1 |
| 5,027,467 | 7/1991 | Tarrson et al. | 15/167.1 |
| 5,029,358 | 7/1991 | Zimmerman | 15/167.1 |
| 5,044,041 | 9/1991 | Ljungberg . | |
| 5,090,080 | 2/1992 | Thuresson et al. . | |
| 5,105,499 | 4/1992 | Dirksing | 15/167.1 |
| 5,142,726 | 9/1992 | Mann | 15/167.1 |
| 5,150,495 | 9/1992 | Discko et al. | 15/167.1 |

FOREIGN PATENT DOCUMENTS

| | | | |
|---|---|---|---|
| 393882 | 4/1924 | Fed. Rep. of Germany | 15/201 |
| 664918 | 4/1929 | France | 15/185 |
| 163502 | 10/1933 | Switzerland | 15/144.1 |

*Primary Examiner*—Harvey C. Hornsby
*Assistant Examiner*—Mark Spisich
*Attorney, Agent, or Firm*—Owen J. Meegan; Aubrey C. Brine; Donal B. Tobin

[57] ABSTRACT

An interproximal brush for carrying on the person has an elongated one piece body member of elastomeric material forming a planar surface disposed between two leg members from which a substantially rigid boss extends for supporting a brush member. A plurality of hinges are formed in the body member at either side of the boss and the oppositely extending leg members are folded one adjacent the other and attached for slidable movement relative to one another. The planar surface is disposed transverse to the direction of relative movement of the leg members and rotates to move the brush from a position in alignment with the direction of movement of the leg members to a position forming an angle with the direction of movement of the leg members, when the leg members are moved relative to one another. The one piece body member may also be made foldable in the opposite direction to encase the brush within the leg members.

12 Claims, 8 Drawing Sheets

INTERPROXIMAL BRUSH

BACKGROUND OF THE INVENTION

The present invention relates to interproximal brush devices for oral care, and more particularly to a brush device which is compact in structure and capable of being carried on the person of the user.

Various teeth cleaning aids have been provided which perform the cleaning of ones teeth and massaging of the gums, the brushes taking on various forms such as wire bristles or foam material and generally are designed to rub or wipe perpendicularly across the gum and tooth surfaces. One brush which has been found useful in this manner is a small, twisted, wire-type, disposable brush wherein bristles are captured between, and extend radially from a pair of twisted metal wires. Brushes of this type are shown and described in U.S. Pat. No. 4,780,923 issued to Schultheiss and U.S. Pat. No. 5,029,358 issued to Zimmerman, both assigned to the assignee of the present invention. These devices have met with commercial success, however due to their construction they are primarily limited for usage in the home as they are not simple to carry on the person of the user. It is therefore necessary to employ the use of toothpicks of wood, or other material, when it is desired to perform a cleaning function between the teeth when the user is at locations other than in the home. However, the use of such devices often is not as satisfactory as the employment of a brush of the type set forth above.

In view of the present emphasis on oral hygiene, and in particular the maintaining of cleanliness in those areas between the teeth on a daily basis, a need has arisen for an interproximal brush which may be easily carried on the person and which is simple to use.

It is therefore an object of the present invention to provide an interproximal brush which is compact in structure and easily carried on the person.

Another object of the invention is to provide an interproximal brush of the type set forth above which is simple in construction and easy to manufacture.

A further object of the invention is to provide an interproximal brush of the type set forth above which is economical to manufacture and therefore economical for the user to replace after a period of usage.

SUMMARY OF THE INVENTION

The above objects and other objectives which will become apparent as the description proceeds are accomplished by providing an interproximal brush having an elongated body member with brush means attached thereto. The body member comprises a pair of parallel legs slidably attached for movement relative one to the other in the direction of the body member axis, and means are provided interconnecting the brush means to the body member whereby movement of the legs relative to one another is effective to move the brush means angularly with respect to the body member axis.

The body member of the brush generally may be manufactured as a unitary element and the brush means may be supported in a substantially rigid boss provided on the body member. The body member may further comprise a flat, planar platform which has the boss formed thereon, at least a portion of the platform substantially transecting the body member axis, and the brush means consists of a brush of the type having an axial stem which is received in the boss. The flat planar platform in provided with a hinge means disposed at either side thereof for connecting the platform to each of the respective legs and the hinge means comprises a pair of grooves formed across the width of the platform on opposite sides of the semi-rigid boss.

A second pair of grooves may be formed across the width of the platform each spaced from the first grooves to form a pair of hinge members which are each hingedly connected to a respective leg for movement thereby.

The interproximal brush body member is generally manufactured of an elastomeric material which is effective to provide the hinge members when grooves are formed in the material.

In one embodiment of the invention a pair of cavities are formed in a respective surface of each of the legs such that when the brush means is mounted on the boss it is enclosed within the cavities with the legs disposed with the cavity surfaces in facing relationship.

BRIEF DESCRIPTION OF THE DRAWING

Reference is made to the accompanying drawing in which there is shown illustrative embodiments of the invention from which its novel features and advantages will be apparent, wherein.

DESCRIPTION OF THE PREFERRED EMBODIMENTS

Figure 3:
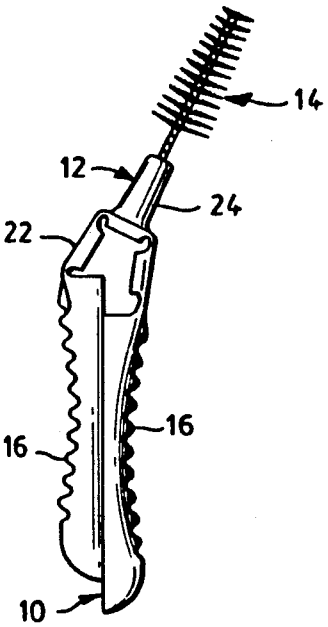
FIG. 3 is a front elevational view similar to FIGS. 1 and 2, showing the structure of the interproximal brush in a second configuration assumed during usage of the brush.
Figure 2:
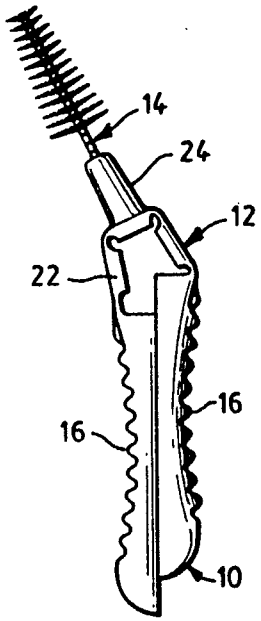
FIG. 2 is a front elevational view similar to FIG. 1, showing the interproximal brush of FIG. 1 in a configuration assumed during usage of the brush.
Figure 1:
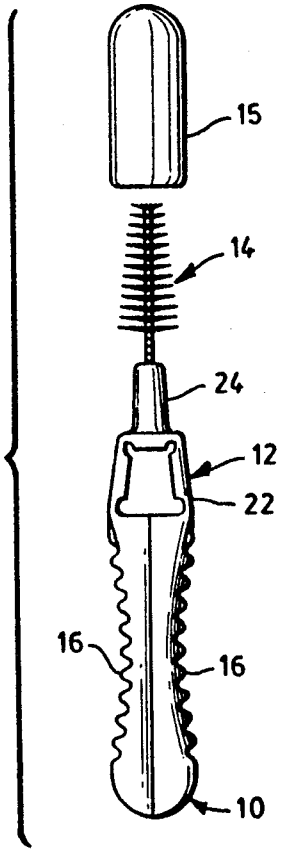
FIG. 1 is a front elevational view showing an interproximal brush constructed in accordance with the teachings of the present invention.
Figure 4:
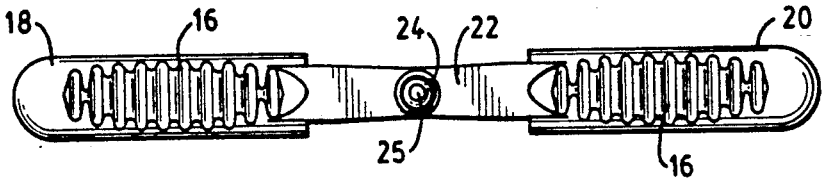
FIG. 4 is a top plan view showing details of the body portion of the interproximal brush of FIGS. 1, 2 and 3.

Referring now to the drawing and in particular to FIGS. 1 through 3 there is shown an interproximal brush 10 comprising a body member 12 and a brush assembly 14. A cap 15 shown in FIG. 1 is provided for covering the brush assembly 14 when the interproximal brush 10 is not in use, and is received as a force fit in interfitting engagement with the body member 12. The interproximal brush 10 is compact in construction so that it may be easily carried on the person of the user, and is therefore preferably between two and three inches in height from the base of the body member to the tip of the brush assembly.

As shown in FIGS. 2 and 3, the body member 12 has a plurality of knurls 16 formed on its surface to provide gripping surfaces for the user to hold the interproximal brush 10 between the thumb and finger, and by manipulation the brush assembly 14 is caused to move to a position wherein the axis of the brush assembly 14 is out of alignment with the general axis of the body member 12, providing the user with a more convenient angle of the brush for cleaning between the teeth.

Referring now to FIGS. 4 through 11, the body member 12 is shown to be formed of a unitary element manufactured of a elastomeric material. The material may be polypropylene or any similar material in which "living hinges" may be formed, as such hinges are well known in the art of plastic construction.

The body member 12 comprises a pair of leg members 18 and 20 the leg members being connected by a substantially flat planar platform 22 having an upper surface from which an upwardly extending boss 24 extends. The boss 24 is formed of the same material as the remainder of the body member 12, however due to the thickness and cylindrical construction is substantially rigid compared with the platform 22 to retain its orientation when in use. The boss 24 has a opening 25 formed therein for receiving the axial stem of the brush assembly 14 in interfitting engagement. The stem of the brush assembly 14 is generally a force fit into the opening 25, and however it may be fixed by adhesive or other mean.

Figure 5:
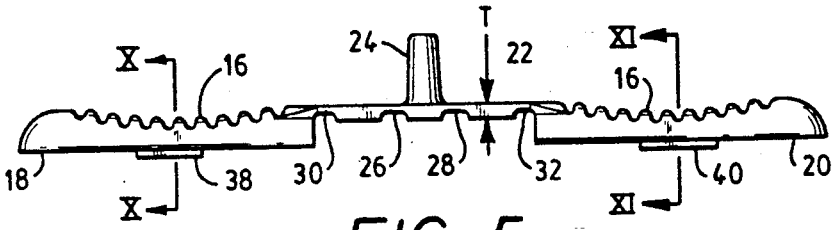
FIG. 5 is a side elevational view of the structure of FIG. 4 showing further details of the brush.
Figure 6:
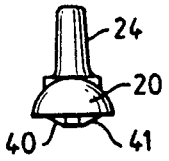
FIG. 6 is an end view of the structure of FIG. 5.
Figure 7:
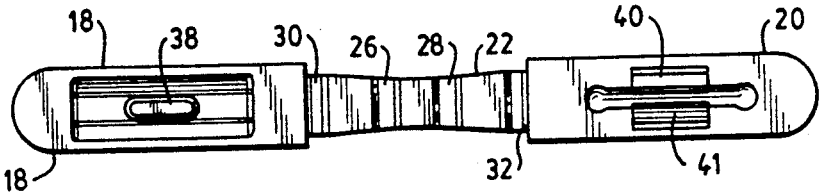
FIG. 7 is a bottom plan view of the structure of FIGS. 4 through 7 showing further details of the brush body portion.
Figure 10:
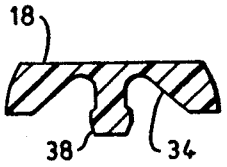
FIG. 10 is an elevational sectional view taken along the line X—X of FIG. 5 taken on an enlarged scale for clarity.
Figure 11:
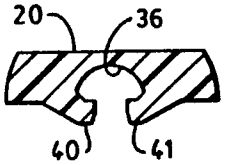
FIG. 11 is an elevational sectional view similar to FIG. 10 taken on the line XI—XI of FIG. 5.
Figure 8:
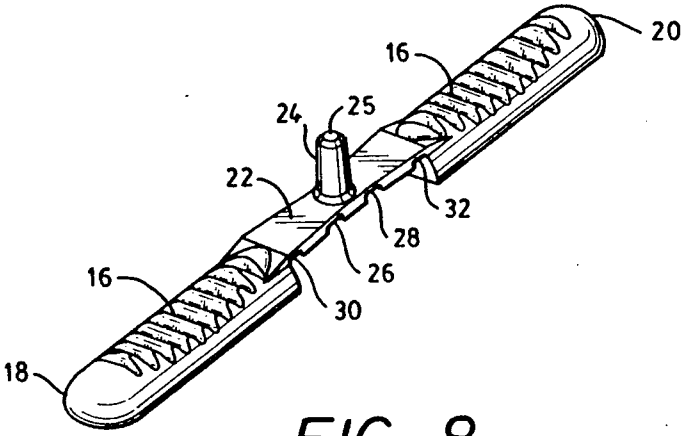
FIG. 8 is an elevational perspective view showing the top details of the brush body member of FIGS. 4 through 7.
Figure 9:
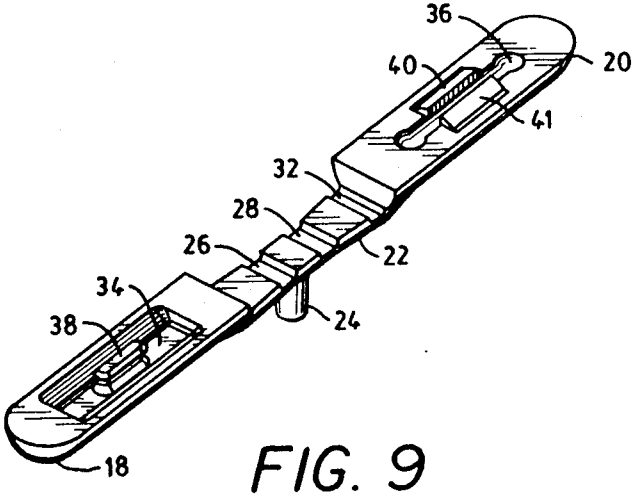
FIG. 9 is an elevational perspective view showing the bottom details of the structure of FIGS. 4 through 8.
Figure 12:
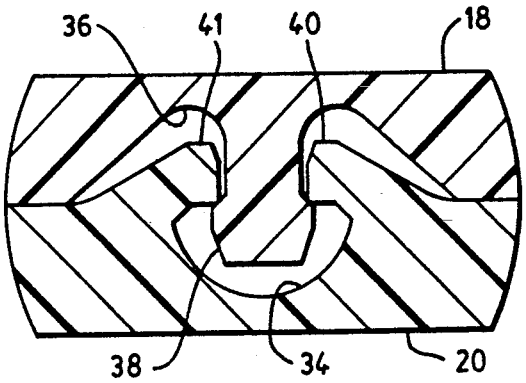
FIG. 12 is an enlarged sectional view showing the elements of the body structure when in the configuration of FIGS. 1 through 3.

As best shown in FIGS. 5, 7 and 9, the platform 22 at its underside contains a plurality of grooves formed thereon, a pair of grooves 26 and 28 being formed across the width of the platform one on either side of the boss 24 to provide a pair of hinges in the platform. A second pair of grooves 30 and 32 are formed across the width of the platform 22 and are each spaced from the first pair of grooves 26 and 28 to provide a second pair of hinges. Each of the grooves 30 and 32 are disposed adjacent the inner extremity of a respective leg member 18 and 20.

In the present construction the thickness T, as shown in FIG. 5, of the platform 22 is in the area of 1.20 mm. and is diminished to a thickness of 0.50 mm. by formation of the grooves 26, 28, 30 and 32. While these dimensions are effective in the present embodiment to form hinges in the platform 22 it is recognized that these dimensions may vary with the employment of various available materials, the objective being that of providing four separate hinges at the locations described, in the platform 22.

Referring now to FIGS. 7, 9, 10 and 11, at the underside of the body member 12 a pair of elongated slotted openings 34 and 36 are formed in the legs 18 and 20 respectively to provide a means for slidably attaching the legs together in forming the interproximal brush 10 of FIGS. 1 through 3. The slotted opening 34 has formed therein an elongated protuberance 38 and the slotted opening 36 has at the edges thereof a pair of elongated flanges 30 and 41 which are spaced at a dimension less than the width of the protuberance 38, however being spaced to allow for the protuberance to be forced between the flanges and into the slotted opening 36. With the protuberance 38 retained within the slotted opening 36 the legs 18 and 20 are held firmly in facing relationship one with the other but are free to slide axially with respect to one another, as depicted in FIGS. 1, 2 and 3.

With the materials employed in the present construction the width of the protuberance 38 is in the area of 1.35 mm. while the minimum opening between the flanges 40 and 41 is in the area of 1.20 mm. In the present construction, these dimensions are effective to allow a snap fit of the protuberance 38 into the slotted opening 34 between the flanges 40 and 41, while retaining the protuberance within the slotted opening during sliding motion of the legs 18 and 20 in the axial direction of the interproximal brush 10, when assembled.

Figure 13:
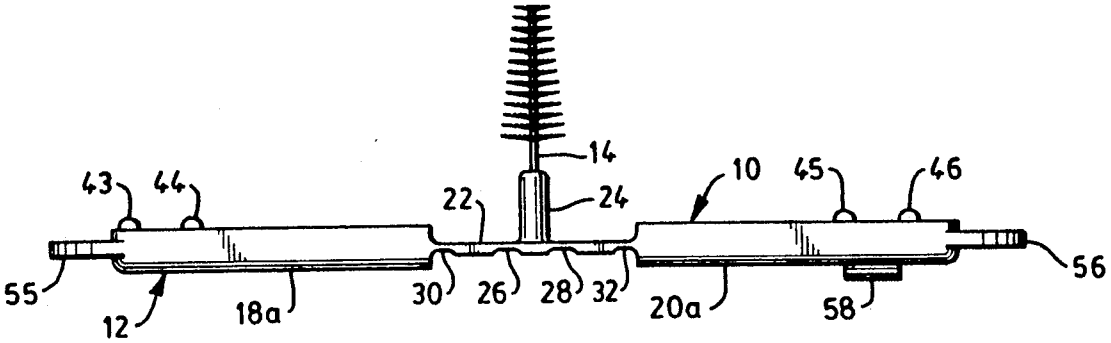
FIG. 13 is a side elevational view of an alternate embodiment of an interproximal brush constructed in accordance with the teachings of the present invention.
Figure 14:
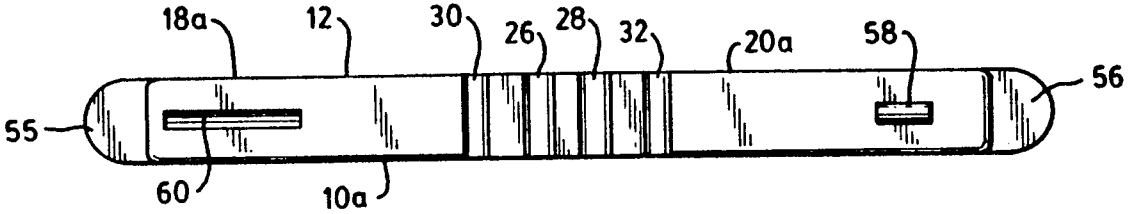
FIG. 14 is a bottom plan view of the brush of FIG. 13 showing details of the body structure.
Figure 15:
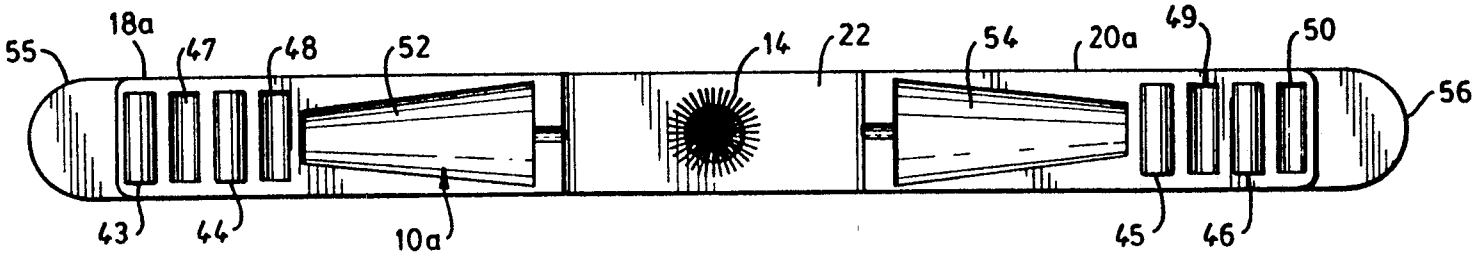
FIG. 15 is a top plan view showing further details of the body structure of FIGS. 13 and 14.
Figure 16:
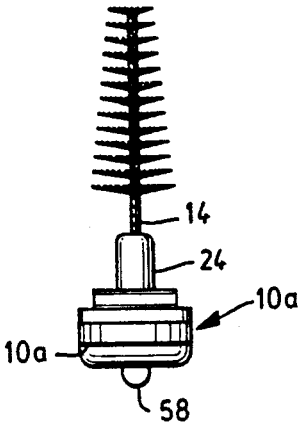
FIG. 16 is an end view of the structure of FIG. 13.

Referring now to FIGS. 13 through 20 there is shown an alternate embodiment of the present invention wherein like elements have been given like reference numerals as those of FIGS. 1 through 12, where applicable. As shown in FIGS. 13, 14 and 15 the interproximal brush 10*a* comprises a body member 12 and brush assembly 14, the brush assembly being mounted into a rigid boss 24 which extends upwardly from a platform 22 having a plurality of grooves 26, 28, 30 and 32 formed therein to provide hinges, as described in the embodiment of FIGS. 1 through 12.

However, in the present embodiment, a pair of legs 18*a* and 20*a* are provided with alternating semi-cylindrical projections 43, 44, 45 and 46, and semi-cylindrical cavities 47, 48, 49 and 50 disposed adjacent the distal end of each of the legs. A pair of cavities 52 and 54 each in the shape of a half frustum is formed having its larger opening adjacent the platform 22 and a pair of extending tabs 55 and 56 are disposed one at each end of the respective leg 18*a* and 20*a*.

Figure 20:
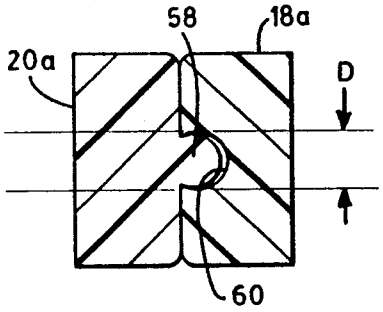
FIG. 20 is a cross-sectional through the gripping portion of the device shown FIG. 19.

At the underside of the leg 20*a* there is disposed a protuberance 58 in the form of an elongated semi-cylinder and an elongated cavity 60 having an internal radial surface is formed in the leg 18*a* for receiving the protuberance 58 as a snap fit, and allowing the protuberance 58 to slide within the cavity. As best shown in FIG. 20, the protuberance 58 has a maximum dimension D which is of greater dimension than the minimum dimension W of the concave cavity 60. The radius of the protuberance 58 is smaller than the radius of the concave cavity 60 such that when the protuberance 58 is snapped into the cavity 60, the legs 20*a* and 18*a* are free to slide one against the other while being retained in surface to surface engagement.

Figure 18:
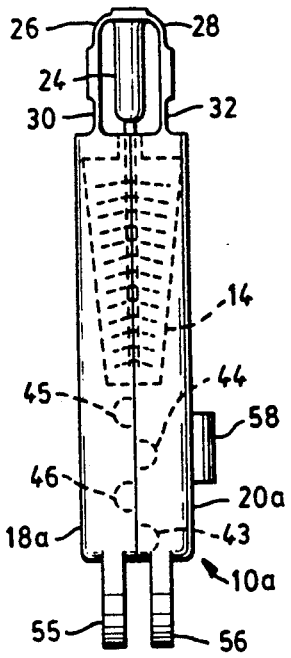
FIG. 18 is an elevational view showing the interproximal brush of FIGS. 13 through 17 in a configuration for storage or carrying on the person of the user.
Figure 17:
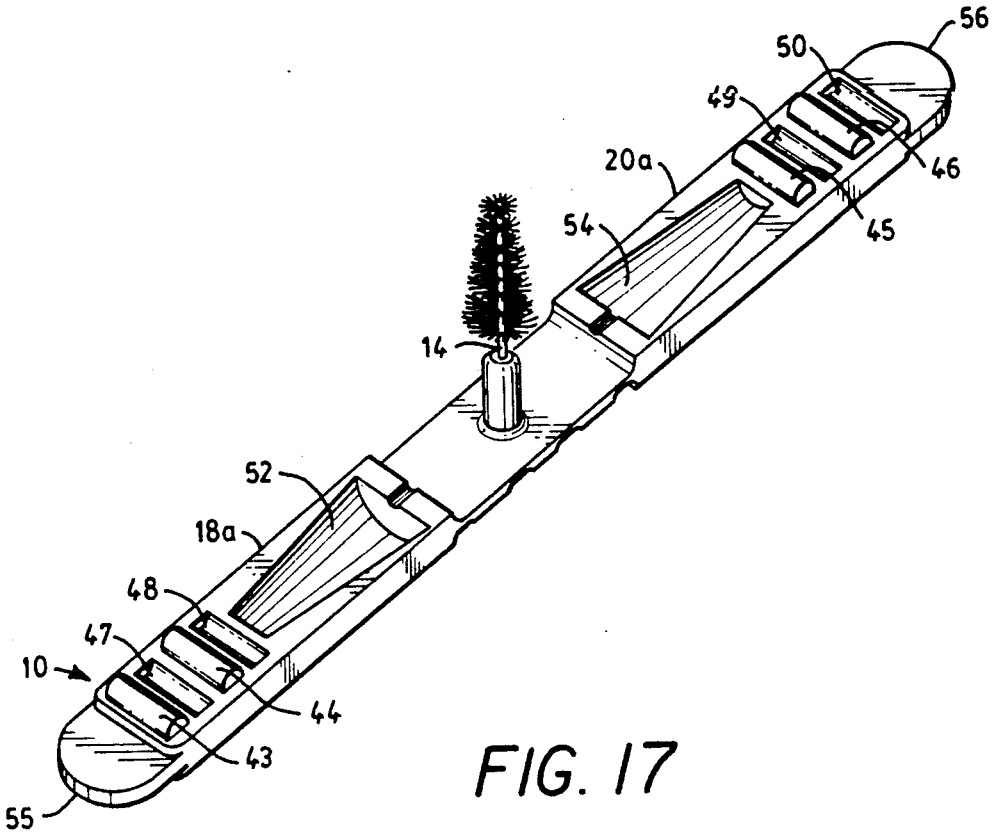
FIG. 17 is a top elevational perspective view of the structure of FIGS. 13 through 16.
Figure 19:
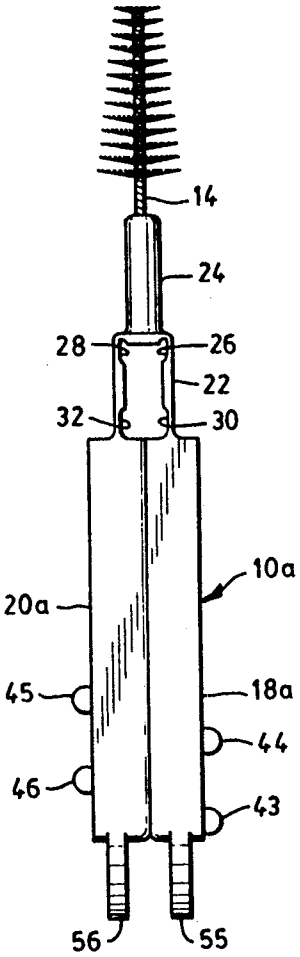
FIG. 19 is an elevational view showing the interproximal brush of FIG. 18 in a configuration during usage.

As best shown in FIGS. 18 and 19, with the legs 18*a* and 20*a* folded such that the brush assembly 14 extends outwardly for employment by the user, the protuberance 58 is snapped into the concave cavity 60 and the legs 18*a* and 20*a* are free to slide one against the other moving the brush assembly 14 in a similar manner to that shown in FIGS. 1, 2 and 3.

It will be noted that no cap is provided for the alternate structure 10*a*, for when the user desires to carry the interproximal brush 10*a* on his person the tabs 55 and 56 are forced apart releasing the protuberance 58 from the cavity 60 and the legs 18*a* and 20*a* are reversed, as shown in FIG. 18, such that the brush assembly 14 is retained within the enclosure formed by the half frustum cavities 52 and 54. The projections 43, 44, 45 and 46 are received in the cavities 47, 48, 49 and 50 which are constructed to provide a snap fit, thereby retaining the interproximal brush 10*a* in the configuration shown in FIG. 18. When it is desired to employ the interproximal brush, the tabs 55 and 56 are employed to unsnap the legs 18*a* and 20*a* one from the other and the legs 18*a* and 20*a* are then returned to the configuration shown in FIG. 19, the tabs being employed to force the protuberance 58 into the cavity 60.

From the foregoing it should be evident that the present invention provides an interproximal brush which is portable and easily carried on the person. It however should be understood that the various features disclosed are susceptible to incorporation into a full size interproximal brush without departing from the spirit of the invention. The structure further is one which is simple to manufacture, employing a minimum number of parts which are easily constructed and assembled.

While it is apparent that changes and modifications can be made within the spirit and scope of the present invention, it is my intention, however, only to be limited by the appended claims.

As my invention I claim:

1. An interproximal brush comprising:

an elongated body member having a longitudinal axis and comprising a pair of parallel legs slidably attached to each other for movement relative one to the other in the direction of the body member longitudinal axis;

a substantially planar platform having a lower surface thereof facing said parallel legs when said legs are attached and brush means disposed on an opposite upper surface thereof and extending outwardly therefrom; and hinge means comprising first and second pairs of hinges, said first pair of hinges formed on said planar platform having one hinge located adjacent one side of said brush means and a second hinge located adjacent an opposite side of said brush means, said second pair of hinges having one hinge connecting said planar platform to one of said parallel legs and the other connecting said planar platform to the other of said parallel legs, said first pair of hinges located intermediate said brush means and said second pair of hinges, whereby movement of said legs relative one to the other is effective to move said brush means angularly with respect to said body member longitudinal axis.

2. An interproximal brush as set forth in claim 1 wherein said body member is a unitary element.

3. An interproximal brush as set forth in claim 1 wherein said brush means is supported in a substantially rigid boss provided on said planar platform.

4. An interproximal brush as set forth in claim 3 wherein said brush means comprises an elongated stem supporting a plurality of radially outwardly extending bristles, said stem being received in said boss.

5. An interproximal brush as set forth in claim 1 wherein said first pair of hinges comprises a pair of grooves formed across said platform on opposite sides of said boss.

6. An interproximal brush as set forth in claim 1 wherein the body member is manufactured of an elastomeric material.

7. An elongated interproximal brush handle comprising a unitary elongated body member formed with a pair of leg members disposed one at each end thereof, said legs being connected by a substantially flat planar platform member located between said legs and having an upwardly extending boss for receiving a brush means, a first pair of grooves formed across said flat planar platform and disposed on opposite sides of said boss to form a first pair of hinges, and a second pair of grooves formed across said flat planar platform, each spaced from said first pair of grooves to form a second pair of hinges each connecting said platform to a respective one of said legs, and means disposed on a lower surface of each of said legs for slidably attaching said legs, one to the other whereby said legs when attached one to the other are slidable along a longitudinal axis of the handle.

8. An interproximal brush handle as set forth in claim 7 wherein the unitary elongated body member is manufactured of an elastomeric material.

9. An interproximal brush handle as set forth in claim 7 wherein said means disposed on the lower surface of each of said legs for slidably attaching said legs one to the other comprises an elongated protuberance disposed on one of said legs and an elongated slotted opening formed in the surface of the other of said legs to receive said protuberance in interfitting slidable engagement.

10. An interproximal brush handle as set forth in claim 7 which further includes a pair of cavities, one formed in an upper surface of each of said legs such that a brush means mounted on said boss is enclosed within said cavities with said legs disposed with the leg upper surfaces in facing relation.

11. An interproximal brush as set forth in claim 10 which further comprises means disposed on the upper surface of each of said legs for attaching said legs one to the other with said upper surfaces and said cavities in facing relation.

12. An interproximal brush handle as set forth in claim 11 wherein the unitary elongated body member is manufactured of an elastomeric material.

* * * * *